US007597059B2

(12) United States Patent
Stutznäcker

(10) Patent No.: US 7,597,059 B2
(45) Date of Patent: Oct. 6, 2009

(54) METHOD AND APPARATUS FOR MANUFACTURING A SEWING PRODUCT

(75) Inventor: Klaus Stutznäcker, Frechen (DE)

(73) Assignee: Nahmaschinenfabrik Emil Stutznacker GmbH & Co. KG, Cologne (DE)

( * ) Notice: Subject to any disclaimer, the term of this patent is extended or adjusted under 35 U.S.C. 154(b) by 0 days.

(21) Appl. No.: 11/974,152

(22) Filed: Oct. 11, 2007

(65) Prior Publication Data

US 2008/0156240 A1 Jul. 3, 2008

(30) Foreign Application Priority Data

Oct. 12, 2006 (DE) ..... 10 2006 048 741

(51) Int. Cl.
*D05B 11/00* (2006.01)
*D05B 37/00* (2006.01)

(52) U.S. Cl. ..... 112/475.08; 112/2.1; 112/117; 112/470.12

(58) Field of Classification Search ..... 112/102, 112/117, 118, 122–139, 165, 199, 475.01, 112/475.08
See application file for complete search history.

(56) References Cited

U.S. PATENT DOCUMENTS 4,597,344 A 7/1986 Stutznacker
4,649,842 A * 3/1987 Backmann ..... 112/475.19
5,040,473 A * 8/1991 Zesch et al. ..... 112/117
5,103,747 A * 4/1992 Resta et al. ..... 112/117
5,287,820 A 2/1994 Stutznacker
5,660,129 A * 8/1997 Murata et al. ..... 112/470.04
5,718,180 A 2/1998 Stutznacker
5,913,277 A * 6/1999 Resta ..... 112/470.12
5,974,994 A 11/1999 Stutznacker et al.
6,123,038 A * 9/2000 Kames et al. ..... 112/117
6,408,773 B2 * 6/2002 Resta ..... 112/2.1
6,895,878 B2 5/2005 Stutznacker
7,066,101 B2 * 6/2006 Codos ..... 112/117
7,191,718 B1 * 3/2007 Myers et al. ..... 112/117

FOREIGN PATENT DOCUMENTS

EP 1 120 486 B1 7/2003

* cited by examiner

*Primary Examiner*—Ismael Izaguirre
(74) *Attorney, Agent, or Firm*—Jones & Smith, LLP; John Wilson Jones

(57) ABSTRACT

The present invention relates to a method for producing a large sewn product, such as a mattress panel or a quilt, having two stitched seams created by a sewing device, moving transversely to the direction of feed, between two adjacently arranged sewn products. The material between said seams is subsequently cut by the sewing unit, located within the sewing device. The apparatus comprises a conveyor mechanism, a sewing device consisting of a sewing unit with at least two needles, a gripper box with grippers allocated to said needles, a tape-like element, a cutting element, and a storage mechanism. By guiding the sewing unit along a first guide means, and by guiding the gripper box along a second guide means, and synchronizing both, material can be cut and sewn on the rim without tension, thereby improving current methods by avoiding sewing inaccuracies and eliminating their subsequent remedies.

30 Claims, 7 Drawing Sheets

METHOD AND APPARATUS FOR MANUFACTURING A SEWING PRODUCT

Figure 1:
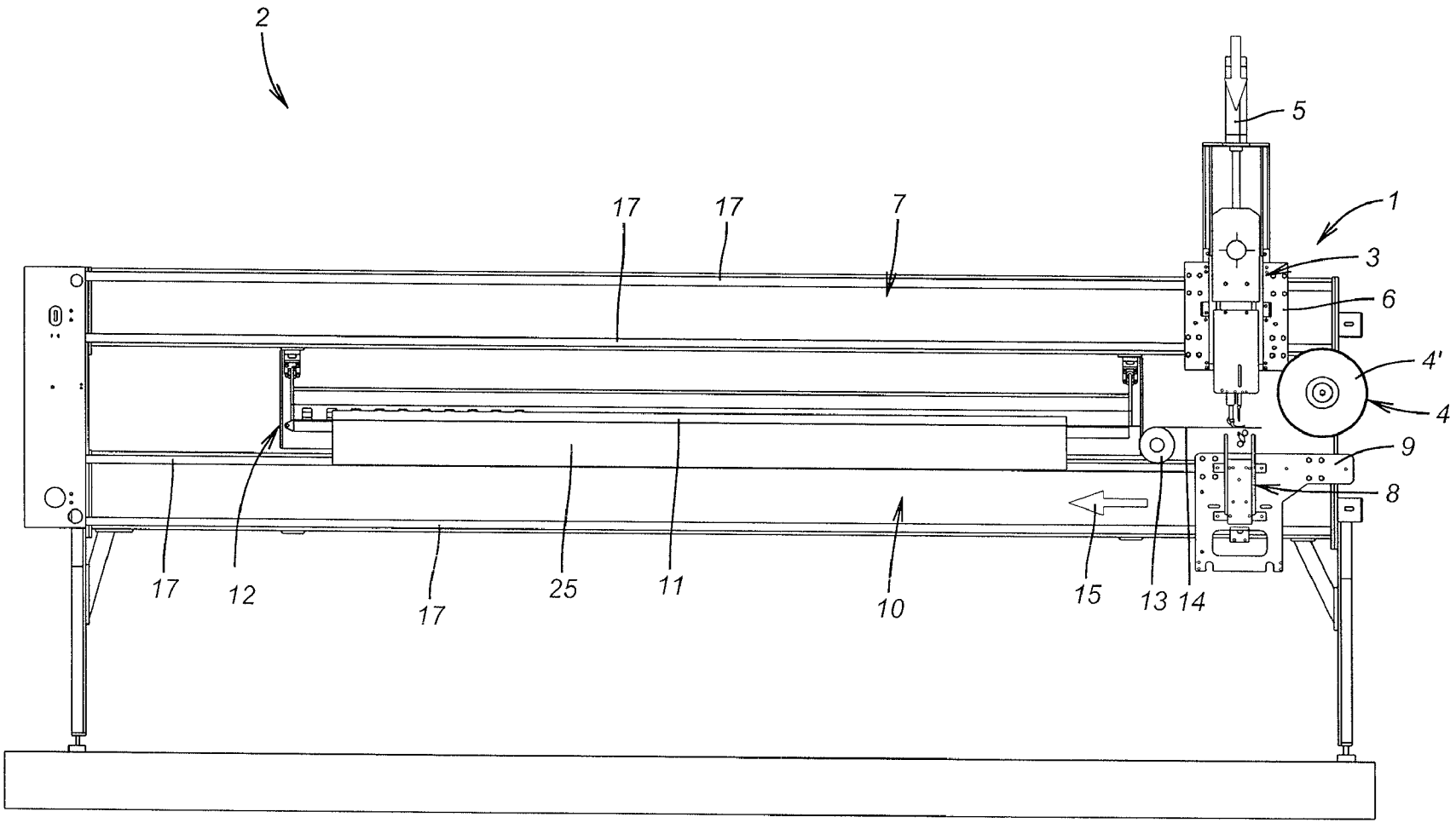

The present invention relates to a method for manufacturing a sewing product, particularly a mattress panel, a quilt or the like, preferably from several sewing product layers that are to be stitched together, as a section of a sewing product material, in which method said sewing product material is, by means of a sewing device that is movable transversely to the conveying direction, provided with at least two stitched seams between two sewing products which are arranged adjacent to each other within the sewing product material, and in which the sewing product material is subsequently cut between these two stitched seams, said sewing device including a sewing unit with needles and a gripper box with grippers allocated to said needles, and a tape-like sewing element being sewed to the sewing product material in the stitched seam area. The invention further relates to an apparatus for manufacturing a sewing product, in particular a mattress panel, a quilt or the like, preferably from several sewing product layers that are to be stitched together, as a section of a sewing product material, which apparatus comprises a conveyor mechanism for conveying the sewing product material, a sewing mechanism consisting of a sewing unit with at least two needles and a gripper box with at least two grippers allocated to the respective needles, a cutting mechanism for separating a sewing product from the sewing product material after the sewing of two stitched seams, transversely to the conveying direction of the sewing product material by a cut between the stitched seams, and a storage mechanism for a tape-like sewing element which may be sewed to the sewing product material in the stitched seam area.

Methods for manufacturing a sewing product are known from prior art. A sewing product is understood to be for instance mattress fabric, particularly mattress cover and/or side panels, quilts or the like. Mattress fabrics are used for being stretched around mattress cores and consist in particular of an outer material and a filler material, for instance foamed material, and these materials are stitched together. Between sewing products that are arranged adjacent to each other, the beginnings or the ends of the sewing products are sewed up by means of at least two and preferably four or more stitched seams transversely to the conveying direction of the sewing product material. Thereafter, the sewing product material is cut between the stitched seams and hemmed with a textile or paper tape In addition, from EP 1 120 486 B1 an apparatus for manufacturing a sewing product is known, in which the sewing product material is withdrawn from a storage mechanism and clamped in a frame. The frame is provided with a crossbeam which extends above the frame transversely to the conveying direction of the sewing product material and which is movable in the conveying direction of the sewing product material relatively to the frame, with a sewing unit being movable thereon. This apparatus for manufacturing a sewing product makes lock stitches with which the sewing product material is stitched according to various patterns which for instance are stored in a computer system and are fetched from a storage for controlling the sewing unit.

The sewing product material may be continuously withdrawn from a storage mechanism and supplied to the frame. The frame consists of two clamping mechanisms extending transversely to the conveying direction of the sewing product material and two tension elements which are movable transversely to the conveying direction.

After non-stretched sewing product material has been fed and clamped into the tension frame, the clamped sewing product section can be provided with the desired lock stitches, with a substantially straight lock stitch seam being made along the clamping mechanism or the tension elements.

After the sewing operation is finished, the rims of the sewing product must be trimmed. To this end, a cross cutter is provided on the apparatus for manufacturing a sewing product, in the region of the end directed away from the storage mechanism. The longitudinal rims of the sewing product material are cut by means of longitudinal cutters.

The cross cutter is arranged on a further sewing mechanism which can be moved transversely to the conveying direction of the sewing product material on guide rails. The sewing mechanism consists of a sewing unit with two or four needles and a gripper box arranged under the sewing unit and containing the grippers for the respective needles. The gripper box carries a roller from which a tape-like material is withdrawn and is sewed by means of the sewing unit to the rims of the sewing product which extend transversely to the conveying direction. In a recess of the gripper box there is further provided a cutting mechanism in the form of a rotating knife cutting the sewing product material having sewed to it the tape-like material. The sewing unit, the cutting mechanism and the gripper box are arranged in a C-shaped housing which can be moved along the guide rails.

It has shown that such a technique does not produce the desired results, because this arrangement of the cross cutter causes tensions in the sewing product material during the separation of the sewing products, which tensions are counterproductive as regards exact processing of the sewing product material, so that an expensive subsequent treatment may be required.

Starting from this prior art, it is a problem of the present invention to further develop a method or an apparatus of the above-described type in such a way that sewing products which are not manufactured with the required accuracy and which therefore require a subsequent treatment can be avoided, particularly avoiding tensions in the sewing product material at least during the cutting operation.

The solution of this problem provides that concerning the method according to the invention the sewing unit and the gripper box are movable along first and second guide rails, respectively and that the movement of the sewing unit and the movement of the gripper box for performing stitches are being synchronized with each other.

Concerning the apparatus according to the present invention the solution of the above-mentioned problem provides that the sewing unit and the gripper box are movable along first and second guide rails, respectively and that the movement of the sewing unit and the movement of the gripper box for performing stitches are synchronized with each other.

Therefore, in the method according to the invention or with the apparatus according to the invention the possibility exists to sew up the rims of the sewing products extending transversely to the conveying direction by the synchronized moving of the sewing unit and the gripper box on different guide rails.

Subsequent to the sewing of the transverse rims of the sewing products the sewing product material can be cut by a cutting mechanism without causing tensions in the sewing product material, since the gripper box, the sewing unit and the cutting mechanism are formed as mutually separate structural units.

According to a further feature of the method according to the invention it is provided that the movement of the sewing unit during the sewing of the stitched seams is mechanically coupled to the gripper box movement. This makes it possible to synchronize the movement of the sewing unit and the gripper box, without any rigid connection between the sewing unit and the gripper box.

According to a further feature of the invention it is provided that the movement of the sewing unit during the sewing of the stitched seams is electronically coupled to the movement of the gripper box. By this construction a synchronized movement of the sewing unit and the gripper box is guaranteed, both along the guide means and the at right angles to the same.

According to a preferred embodiment of the invention it is provided that the sewing product material is cut with a cutting mechanism that is moved along the first or the second guide means. Through the use of a separate cutting mechanism the cutting of the sewing product material can be performed at a distance to the sewing position which is sufficient to avoid tensions in the sewing product material at the sewing position which are caused by the cutting and separation of the sewing product material and which stand in the way of an exact processing.

According to a further advantageous embodiment of the invention it is provided that the cutting mechanism is moved together with the sewing unit or the gripper box. This common movement takes place along one of the guide means and can be effected via a mechanical and/or electronic coupling. Also, this common movement can take place additionally at right angles to the guide means, either synchronously or also time-shifted from each other.

According to a further feature of the invention it is provided that the sewing unit after the completion of the stitched seams is moved to a lifted position. Because of this construction the sewing unit can be moved over the sewing product material without contact, whereby it is prevented that for instance needles get caught in the sewing product material. Moreover, the sewing product material is moved on after the sewing and cutting operations, so that lifting the sewing unit will prevent needles from getting caught in the sewing product material also while the material is moved on.

A further advantageous embodiment of the invention provides that after the completion of the stitched seams and after the cutting of the sewing product material the sewing unit is returned to an initial position, whereupon a next sewing operation can be performed. But it is also conceivable that the end position corresponds to the initial position, which means that the sewing unit sews up the sewing product material in both movement directions along a guide rail. With such an embodiment of the invention a second cutting mechanism can be provided, in order that the sewing product material can be cut independently of the sewing direction.

According to a further feature of the invention it is provided that the tape-like sewing element is sewed onto the sewing product material during sewing the stitched seams. By sewing the tape-like element onto the sewing product material the rims of the sewing material are reinforced. After this sewing-on operation the cutting operation can be performed, so that the tape-like sewing element is cut simultaneously with the sewing product material. The sewing element has a width exceeding the stitched seam area, so that the sewing element is not sewed up over the full area thereof. Thus the rims of the sewing product are provided with a free sewing element section which at the production of mattresses is connected for instance to the mattress core by means of metal clamps, in order to restrict and particularly prevent a relative movement of the mattress panel and the mattress core.

According to a further feature of the invention it is provided that the sewing product material is withdrawn from a multi-needle sewing machine, in particular a multi-needle chain stitch sewing machine or a multi-needle lock stitch sewing machine, and supplied to the sewing unit.

An advantageous improvement of the apparatus according to the invention is obtained by that the guide means are formed as parallel extending crossbeams which have movably arranged thereon the sewing unit, the gripper box and the cutting mechanism. The crossbeams can be fixed to a frame and can have a rail-like form.

According to a further embodiment of the invention the sewing product material is guided between the said guide means. In this way, processing of the sewing product material is possible from both sides, so that the sewing unit is moved above and the gripper box below the sewing product material or vice versa.

According to a further feature of the invention it is provided that the sewing unit includes four needles and the gripper box four corresponding grippers. Through the use of four sewing organs respectively the rims of the sewing product are each provided with two stitched seams, whereby the sewing quality is increased.

According to a further feature of the invention it is provided that at least the sewing unit is relatively movable at a distance to the sewing product material. Accordingly, the sewing unit can be moved to a lifted position, so that for instance any needles cannot get caught in the sewing product material when after the sewing operation the sewing unit is moved along a guide means.

A further advantageous embodiment of the invention provides that the sewing unit is movable by means of a linear motor, for instance a hydraulic or pneumatic cylinder or a rack-and-pinion gear. With that the sewing unit can be relatively moved at a distance to the sewing product material.

According to a further advantageous embodiment of the invention the sewing unit is mechanically coupled to the gripper box. A mutually synchronized operation of the sewing unit and the gripper box can be produced thereby, so that an exact sewing-up is made possible also under a fast movement of the sewing unit and the gripper box along the guide means.

According to a further feature of the invention it is provided that the mechanical coupling is formed as a belt drive, in particular a toothed belt drive. Deflection of the belts is possible for example on gears which are provided, in order to couple the movements of the sewing unit and the gripper box.

A further advantageous embodiment of the invention provides that the mechanical coupling is formed as a gear drive with racks and/or worms.

According to a further advantageous form of construction of the invention the sewing unit is electronically coupled to the gripper box, whereby an exact synchronization of the sewing unit and the gripper box is made possible. In this context it is also conceivable that the sewing unit and the gripper box have separate drives which are electronically controlled.

According to a preferred embodiment of the invention it is provided that the cutting mechanism is movable together with the sewing unit and/or the gripper box along a guide means. For this reason, any further electronic coupling is not required for the movement of the cutting mechanism.

According to a further advantageous embodiment the cutting mechanism includes a circular cutting blade. This can be rotated by means of drive mechanism, so that a rapid and exact cutting of the sewing product material can be effected at an appropriate rotational speed.

A further advantageous embodiment of the invention provides that the cutting mechanism is relatively movable at a distance to the sewing product material. Thereby, any contact is prevented between the sewing product material and the cutting mechanism after the cutting of the sewing product material and the sub-sequent movement of the cutting mechanism and the conveying of the sewing product material. The cutting mechanism can be coupled for instance to the sewing unit or to the gripper box which are simultaneously moved relatively and at a distance to the sewing product material. But a time-shifted movement of the cutting unit is also possible, so that the sewing unit is for example lifted at the end of a stitched seam, whereupon the cutting mechanism following the sewing unit is maintained in the cutting position up to this end and is lifted after it has reached this end.

According to a further feature of the invention it is provided that the storage mechanism for the tape-like sewing element is arranged on the sewing unit and/or the gripper box. The storage mechanism can for instance be formed as a roll, where the tape-like sewing element is withdrawn from. If the sewing unit and the gripper box are provided with such a storage mechanism, the rims of the sewing product can be provided with the reinforcing tape-like sewing element from both sides, whereby the quality of the reinforcement increased.

According to an advantageous embodiment of the invention it is provided that in the region of the guide means the conveyor mechanism includes a support element adapted to be displaced parallel to the conveying direction of the sewing product material and covering a gap in the conveyor mechanism during the conveying of the sewing product material. Said gap is arranged in the region of the sewing unit and extends transversely to the conveying direction. The support element is moved over the gap by a lever mechanism for example, when the sewing product material is moved on for the production of a further sewing product, with the support element being located between the sewing product material and the surface. In this way, the sewing product material is prevented from falling into the gap or from being deflected.

A further advantageous embodiment of the invention provides that the support element includes on its surface facing the sewing product material a signal element for controlling the sewing unit and/or the cutting mechanism. The signal element is formed for instance as a reflector. If for example the sewing unit is provided on its underside with an illumination means for illuminating the signal element, light emitted from the illumination means will be reflected from the signal element when the same is under the sewing unit. Reflected light can then be registered by a light-sensitive means which is also provided on the sewing unit, for instance a sensor, whereby the sewing unit and the cutting mechanism receive a signal indicating a longitudinal edge portion of the sewing product material.

According to a further feature of the invention it is provided that the sewing device is arranged upstream of a multi-needle sewing machine, particularly a multi-needle chain stitch sewing machine or a multi-needle lock stitch sewing machine. With this sewing device the sewing product material can be sewed up or quilted, and it is possible to generate desired patterns by the stitched seams.

A further advantageous embodiment of the invention provides that the sewing device includes a downstream conveyor mechanism for sewing products separated from sewing product material, in particular a stacking mechanism. In this way, the sewing product can be quickly removed from the processing area and a new sewing product produced without hindrance.

According to a further feature of the invention it is provided that the conveyor mechanism includes two clamping elements respectively arranged upstream and downstream of the sewing device. These clamping elements clamp the sewing product material, so that the same is in a stretched condition during its processing.

Figure 2:
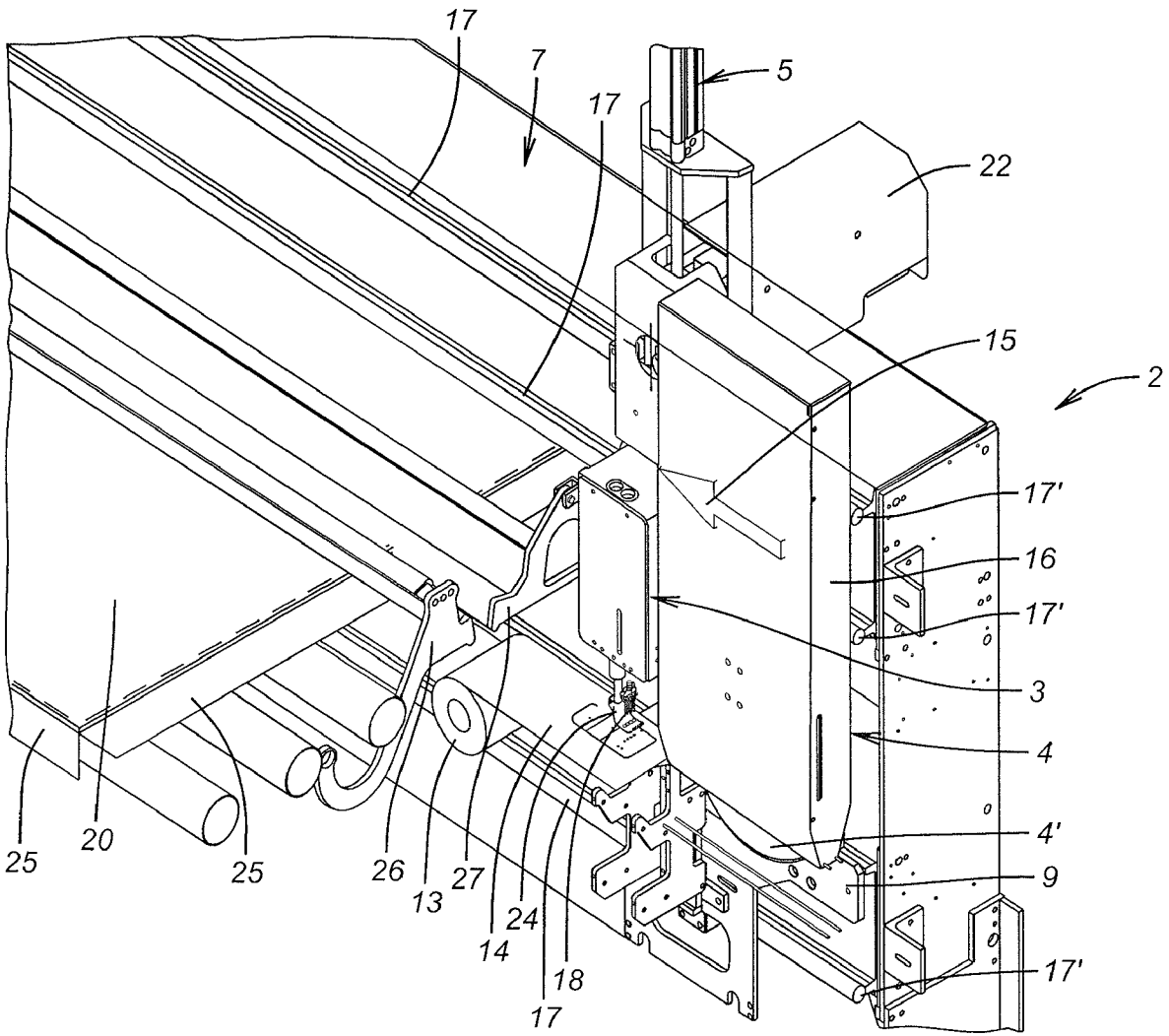
Figure 3:
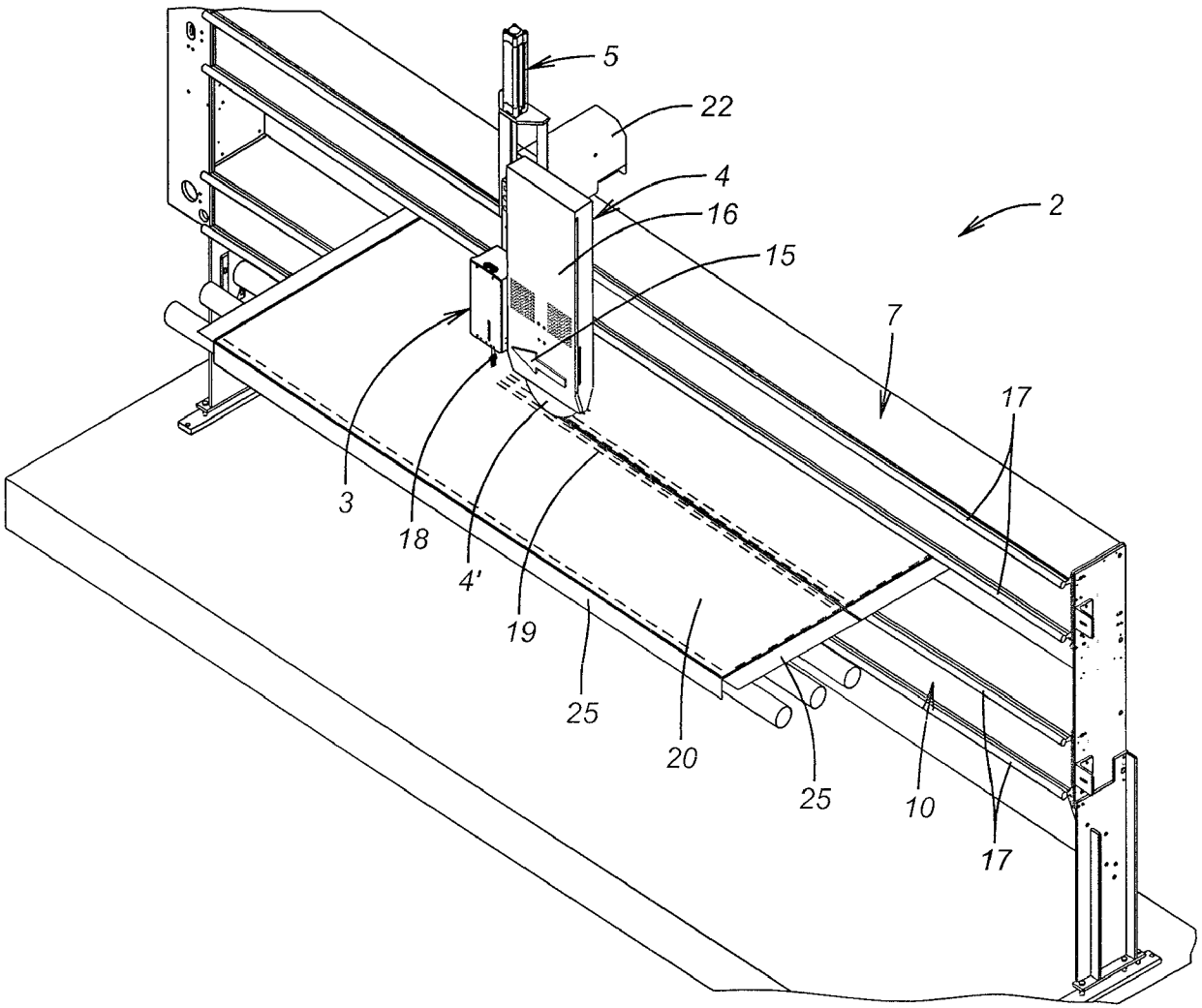
Figure 4:
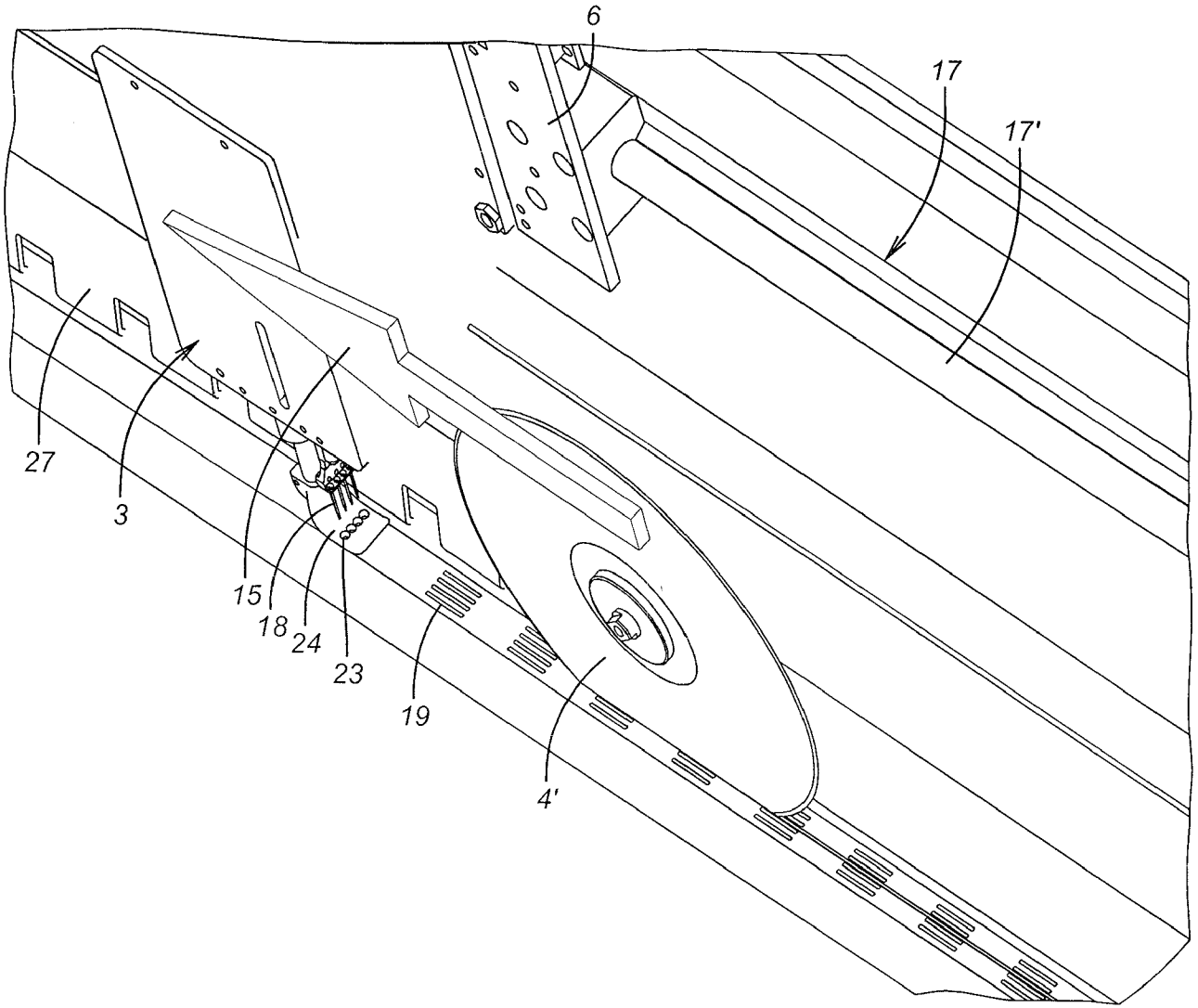
Figure 5:
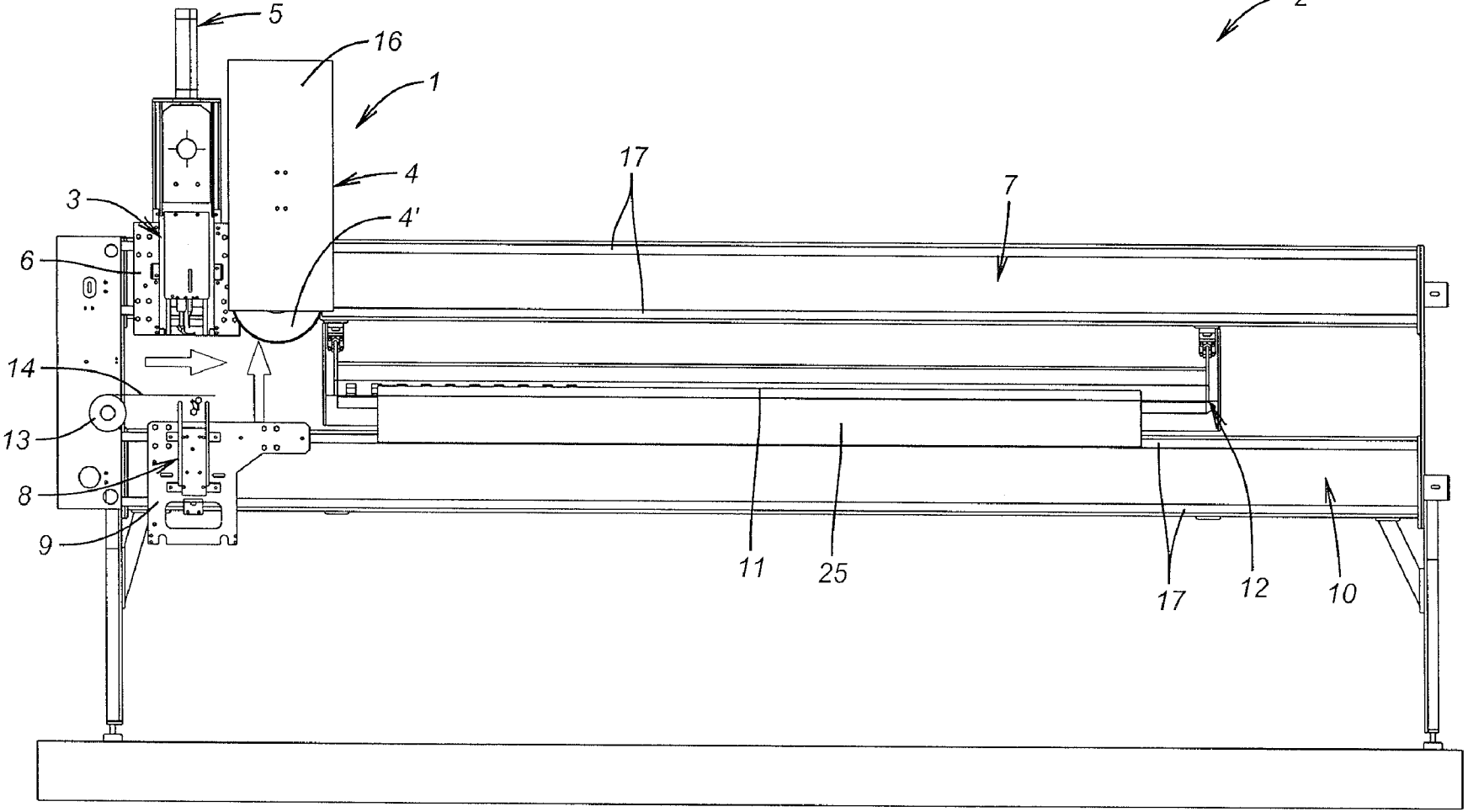
Figure 6:
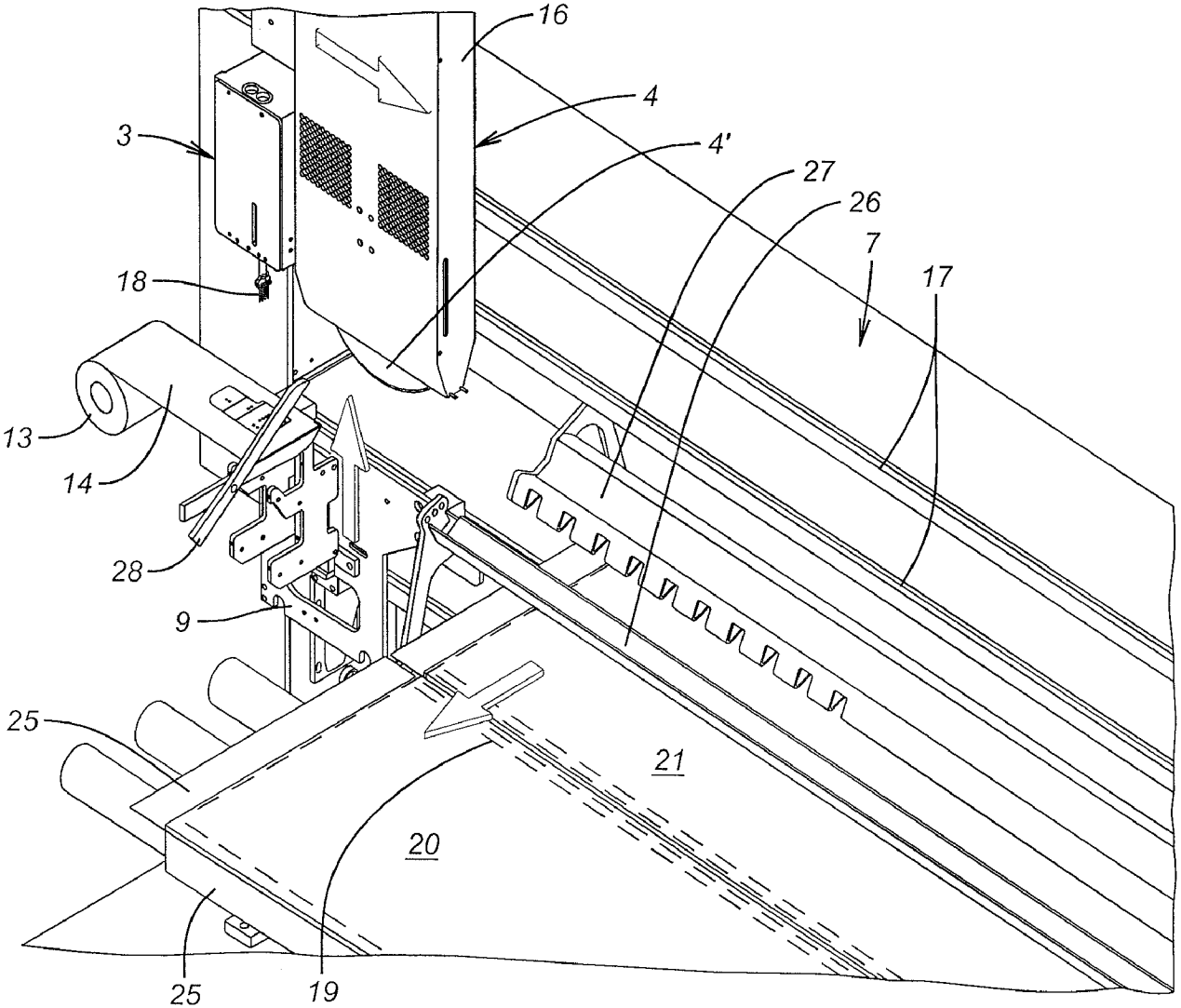
Figure 7:
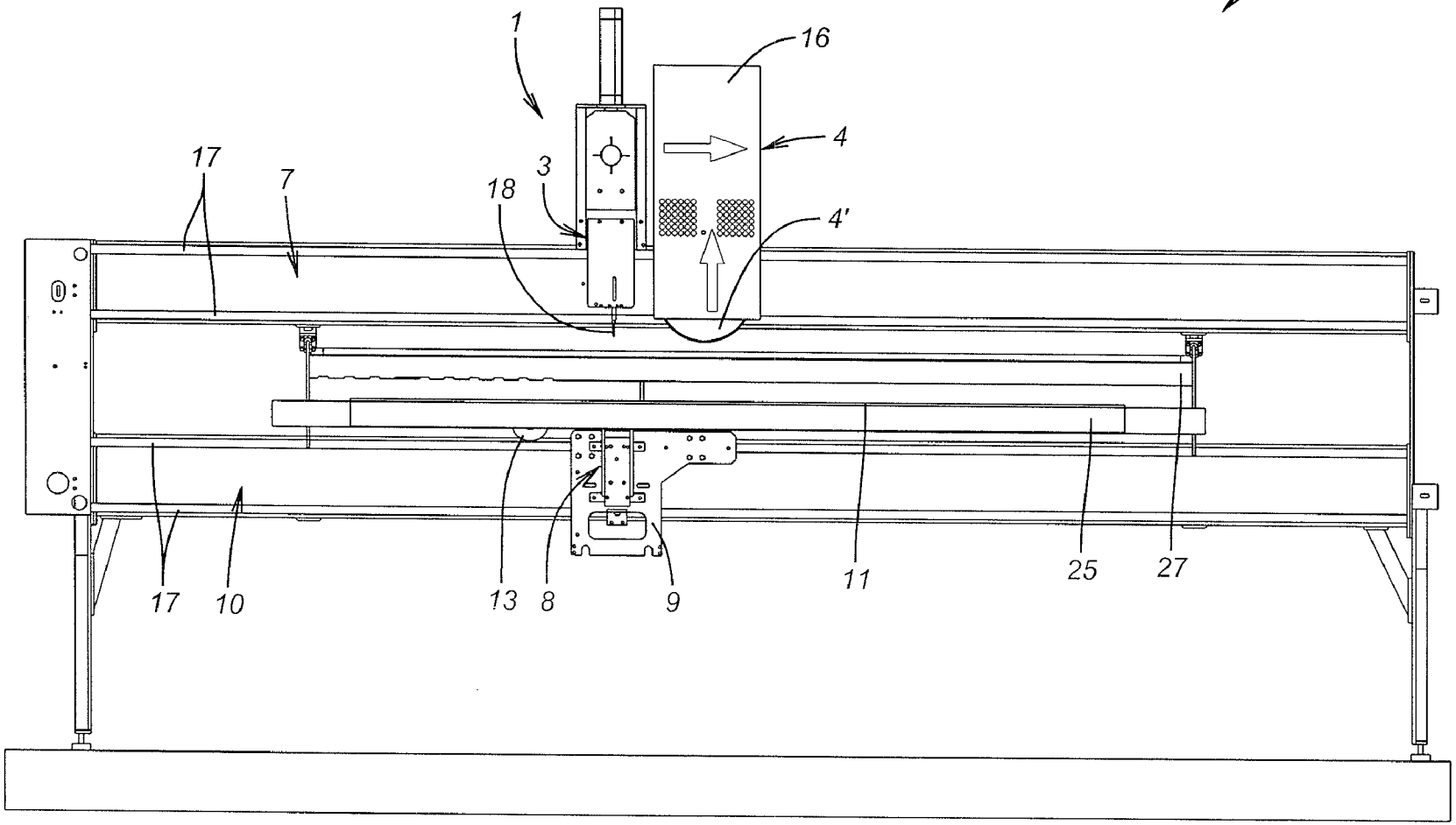

Further advantages and features of the present invention will become apparent from the embodiments illustrated in the attached drawings, wherein it is shown by FIG. 1 a front view of an embodiment for an apparatus according to the invention for manufacturing a sewing product, in an initial position;

FIG. 2 a perspective detailed view of the embodiment shown in FIG. 1;

FIG. 3 a perspective view of the apparatus according to the invention in a working position;

FIG. 4 a perspective detailed view of the working position as shown in FIG. 3;

FIG. 5 a front view of the apparatus according to the invention in and end position;

FIG. 6 a perspective detailed view of the end position as shown in FIG. 5; and FIG. 7 a front view of the apparatus according to the invention during returning to the initial position.

In FIG. 1 an apparatus 2 for manufacturing a sewing product 20, 21 (see FIG. 3) is shown having arranged thereon a sewing device 1 with a sewing unit 3, a gripper box 8 and a cutting mechanism 4. The sewing device 1 is in an initial position. In this initial position the sewing unit 3 and the cutting mechanism 4 which is formed as a circular cutting wheel 4' are lowered, which in this embodiment is effected through a pneumatically operated driving means 5. The sewing unit 3 and the cutting mechanism 4 are fixed to a base plate 6 and are arranged on a guide means which is in the form of a crossbeam 7 which guarantees stable and safe guiding. The gripper box 8 is also fixed to a base plate 9 which is guided on a crossbeam 10 extending parallel to the crossbeam 7. The crossbeams 7, 10 are interconnected at the ends thereof by a portal 2 by a screwed connection. Between the crossbeam 7 of the sewing unit 3 and the crossbeam 10 of the gripper box 8 a sewing product material 11 is arranged which during a sewing and cutting operation is clamped by means of a clamping mechanism 12 comprised of two clamping elements 26, 27 (see FIG. 2). Arranged on the gripper box 8 is a storage mechanism 13 for a tape-like sewing element 14, said storage mechanism 13 being arranged in the sewing direction according to arrow 15 before the gripper box 8.

FIG. 2 shows a detailed view of the device illustrated in FIG. 1, with the cutting mechanism 4 including a housing 16, through an underside opening thereof a part of the cutting wheel 4' protrudes. The housing 16 prevents any contact between objects or parts of a body and the cutting wheel 4'. The crossbeams 7, 10 include on their front side facing towards the sewing device 1 rails 17 that extend in the longitudinal direction thereof and have a rail head 17' with a circular cross-section. On these rails 17 rollers are guided which are connected to the base plates 6, 9. There are respectively provided two parallel extending rails 17 for the sewing unit 3 and the gripper box 8. In the illustrated initial position a length of the tape-like sewing element 14 is withdrawn from the storage mechanism 13 and is positioned between the needles 18 of the sewing unit and the gripper box 8.

Furthermore, the driving unit 22 of the sewing unit 3 can be seen, driving the needles 18. In FIG. 2 sections 25 of the sewing element 14 can be seen which extend over the lateral rims of the sewing product 20, 21. At the manufacturing of mattresses these sections 25 are connected to a mattress core for permanently holding the mattress panel in its position.

The clamping mechanism 12 consists of two clamping elements 26, 27 which clamp the sewing product material 11 in a stretched condition during the sewing and cutting operations, so that the sewing and cutting can be performed safely and at high speed.

In FIG. 3 the device 1 according to the present invention is shown in a further working position. Four stitched seams 19 can be seen, with the cutting mechanism 4 cutting the sewing product material 11 in the center between two stitched seams 19, so that the rims of the sewing products 20, 21 are provided with two stitched seams 19. During the sewing operation the tape-like sewing element 14 is simultaneously sewed to the sewing product material 11 from the bottom side and is thereafter also cut by the cutting mechanism 4, so that the rims of the sewing product 20, 21 are reinforced by this tape-like sewing element 14.

FIG. 4 shows a detailed view of that what has been shown in FIG. 3, with the four needles 18 to be seen which are able to penetrate through four openings 23 in a pressure foot 24.

In FIG. 5 the apparatus 2 according to the invention is shown in an end position in which the sewing and cutting operations are concluded. The sewing unit 3 and the cutting mechanism 4 are in a raised position and for this reason can be returned to the initial position (FIG. 1) in a non-contacting fashion along crossbeam 7. At the same time the gripper box 8 is returned to the initial position along crossbeam 10.

FIG. 6 shows a detailed view of the apparatus 2 illustrated in FIG. 5. It can be seen in this figure that the clamping elements 26, 27 are opened at the end of the sewing and cutting operations, so that simultaneously with the returning of the sewing unit 3, the gripper box 8 and the cutting mechanism 4 to the initial position according to FIG. 1 the sewing product material 11 can be conveyed, so that a new working cycle can begin. In FIG. 6 there is further shown an additional cutting mechanism 28 for cutting the tape-like sewing element 14 at the end of the sewing and cutting operations.

FIG. 7 shows the apparatus according to the invention being returned to the initial position according to FIG. 1.

The method according to the present invention for manufacturing a sewing product begins with the step that sewing product material 11 is conveyed to a sewing and cutting area and is withdrawn for this purpose from a multiple needle sewing machine, simultaneously sewing up the longitudinal sides of the sewing material product that extend parallel to the conveying direction. In addition, a tape-like sewing element 14 may be sewed to the longitudinal sides, and said tape-like sewing element 14 is not sewed up over the full area thereof, so that a free section 25 extends along one longitudinal side of the sewing product material 11. At this point of time the sewing unit 3 and the cutting mechanism 4 are in their raised positions.

To prevent the sewing product material 11 from falling into a gap formed in the conveyor mechanism or from being deflected towards the same, at the conveying of the sewing product material 11 a support element is moved over this gap by means of lever mechanism. On the upper side of the support element there is a signal element which signalises to the sewing device 1 a rim portion of the sewing product material 11, at which rim portion the subsequent sewing and cutting operation has to begin. After signalising the gap is exposed again by withdrawing the support element. At the same time the sewing device 1 moves to its initial position (FIG. 1) in which it begins working, i.e. with the next sewing and cutting operations.

To this end, the sewing unit 3 and cutting mechanism 4 are lowered by means of a drive mechanism 5 until they contact the sewing product material 11. In a next step the sewing device 1 is moved according to arrow 15 along the crossbeams 7, 10, with the sewing product material layers being stitched together. Simultaneously, the tape-like sewing element 14 is withdrawn from the storage mechanism 13 and is sewed to the sewing product material 11 from the bottom side. During its movement along the crossbeam 7 the sewing unit 3 is followed by the cutting mechanism 4 which cuts the sewing product material 11 between the stitched seams 19, so that individual sewing products 20, 21 are formed. The tape-like sewing element 14 is formed with a width sufficient for not being sewed up over the full area thereof, so that free sections 25 are arranged also on the transverse rims of the sewing product material 11. During this sewing and cutting operations the sewing unit 3 and the gripper box 8 are mutually synchronized with regard to their movements along the respective crossbeams 7, 10, so that the needles 18 and the gripper 8 cooperate in a reliable fashion, with the cutting mechanism 4 being moved in common with the sewing unit 3. When the sewing device 1 has arrived at its end position, the sewing unit 3 and thereafter the cutting mechanism 4 will be moved to their raised positions, so that another length of sewing product material 11 can be conveyed into the working area, after the previously finished sewing product 20, 21 has been removed from the sewing and cutting area. The sewing device 1 thereafter returns to its initial position, so that another length of sewing product material 11 can be processed and another sewing product 20, 21 manufactured.

The above-described embodiments merely serve for explaining the invention and are not in any sense limiting.

LIST OF REFERENCE NUMBERS

1 sewing device
2 apparatus
3 sewing unit
4 cutting mechanism
4' cutting wheel
5 drive unit
6 base plate
7 crossbeam
8 gripper box
9 base plate
10 crossbeam
11 sewing product material
12 clamping element
13 storage mechanism
14 sewing element
15 arrow
16 housing
17 rail
17' rail head
18 needles
19 stitched seam
20 sewing material
21 sewing material
22 drive unit
23 opening
24 pressure foot
25 section
26 clamping element
27 clamping element
28 cutting mechanism

The invention claimed is:

1. Method for manufacturing a sewing product as a section of a sewing product material, in which method said sewing product material is, by means of a sewing device that is movable transversely to the conveying direction, provided with at least two stitched seams between two sewing products which are arranged adjacent to each other in the sewing product material, and in which the sewing product material is subsequently cut between these two stitched seams, said sewing device including a sewing unit with needles and a gripper box with grippers allocated to said needles, and a tape-like sewing element, characterized in that during the sewing of the stitched seams said sewing unit is moved along a first guide means and the gripper box is moved along a second guide means, and that the movements of the sewing unit and the gripper box are synchronized with each other.

2. Method according to claim 1, characterized in that during the sewing of the stitched seams the movement of the sewing unit is being mechanically coupled to the movement of the gripper box.

3. Method according to claim 1, characterized in that during the sewing of the stitched seams the movement of the sewing unit is being electronically coupled to the movement of the gripper box.

4. Method according to claim 1, characterized in that the sewing product material is cut by means of a cutting mechanism which is moved along the first or the second guide means.

5. Method according to claim 4, characterized in that the cutting mechanism is moved in common with the sewing unit or with the gripper box.

6. Method according to claim 1, characterized in that after completion of the stitched seams the sewing unit is moved to a raised position.

7. Method according to claim 1, characterized in that after completion of the stitched seams and after the cutting of the sewing product material the sewing unit is returned to an initial position.

8. Method according to claim 1, characterized in that during the sewing of the stitched seams at least one tape-like sewing element is sewed to the sewing product material.

9. Method according to claim 1, characterized in that the sewing product material is withdrawn from a multi-needle sewing machine and supplied to the sewing device.

10. Method according to claim 9, characterized in that the multi-needle sewing machine is a multi-needle chain stitch sewing machine or a multi-needle lock stitch sewing machine.

11. Method according to claim 1, characterized in that the sewing product is a mattress panel or a quilt made from several sewing product layers to be stitched together.

12. Apparatus for manufacturing a sewing product as a section of a sewing product material, said apparatus comprising a conveyor mechanism for conveying the sewing product material, a sewing device consisting of a sewing unit with at least two needles and a gripper box with at least two grippers respectively allocated to the needles, and a cutting mechanism, by means of which after the sewing of two stitched seams a sewing product can be separated from the sewing product material transversely to the conveying direction of the sewing product material by a cut between the stitched seams, and a storage mechanism for a tape-like sewing element which can be sewed to the sewing product material in the stitched seam area, characterized in that the sewing unit is movable along a first guide means and the gripper box is movable along a second guide means, and that the movements of the sewing unit and the gripper box for performing stitches are synchronized with each other.

13. Apparatus according to claim 12, characterized in that the guide means are formed as parallel extending crossbeams.

14. Apparatus according to claim 12, characterized in that the sewing product material is guided between the guide means.

15. Apparatus according to claim 12, characterized in that the sewing unit includes four needles and the gripper box includes four allocated grippers.

16. Apparatus according to claim 12, characterized in that at least the sewing unit is relatively movable at a distance to the sewing product material.

17. Apparatus according to claim 16, characterized in that the sewing unit is movable by means of a linear motor, for instance a hydraulic or pneumatic cylinder or a rack-and-pinion gear.

18. Apparatus according to claim 12, characterized in that the sewing unit is mechanically coupled to the gripper box.

19. Apparatus according to claim 18, characterized in that the mechanical coupling is formed as a belt drive.

20. Apparatus according to claim 19, characterized in that the mechanical coupling is formed as a toothed belt drive.

21. Apparatus according to claim 18, characterized in that the mechanical coupling is formed as a gear drive with racks and/or worms.

22. Apparatus according to claim 12, characterized in that the sewing unit is electronically coupled to the gripper box.

23. Apparatus according to claim 12, characterized in that the cutting mechanism is movable in common with the sewing unit and/or the gripper box along a guide means.

24. Apparatus according to claim 12, characterized in that the cutting mechanism includes a circular cutting blade.

25. Apparatus according to claim 12, characterized in that the cutting mechanism is relatively movable at a distance to the sewing product material.

26. Apparatus according to claim 12, characterized in that the sewing unit and/or the gripper box include a storage mechanism for a tape-like sewing element.

27. Apparatus according to claim 12, characterized in that the sewing device includes an upstream multi-needle sewing machine, in particular a multi-needle chain stitch sewing machine or a multi-needle lock stitch sewing machine.

28. Apparatus according to claim 12, characterized in that the sewing device includes a downstream conveyor mechanism for sewing product separated from the sewing product material.

29. Apparatus according to claim 12, characterized in that the conveyor mechanism includes two clamping elements upstream respectively downstream of the sewing device.

30. Apparatus according to claim 28, characterized in that the downstream conveyor mechanism is a stacking mechanism.

* * * * *